US006681893B1

(12) United States Patent
Coulson

(10) Patent No.: US 6,681,893 B1
(45) Date of Patent: Jan. 27, 2004

(54) LADDER STANDOFF DEVICE

(76) Inventor: Lonnie Coulson, 2511 Stella St., Fairmont, MN (US) 56031

( * ) Notice: Subject to any disclaimer, the term of this patent is extended or adjusted under 35 U.S.C. 154(b) by 0 days.

(21) Appl. No.: 10/143,703

(22) Filed: May 10, 2002

(51) Int. Cl.[7] ..... E04G 5/02; E06C 7/06
(52) U.S. Cl. ..... 182/107; 182/214; 182/121
(58) Field of Search ..... 182/107, 214, 182/206, 127, 129, 108, 20, 39, 13–17, 121

(56) References Cited

U.S. PATENT DOCUMENTS 4,938,312 A * 7/1990 Trail ..... 182/214 X
5,165,501 A * 11/1992 Donahey ..... 182/214

* cited by examiner

*Primary Examiner*—Hugh B. Thompson II
(74) *Attorney, Agent, or Firm*—Haugen Law Firm PLLP

(57) ABSTRACT

A ladder standoff device including first and second support bracket assemblies operably coupled to a ladder, wherein the first and second support bracket assemblies are operably coupled to one another, and rotatable stabilization devices secured to respective first and second support bracket assemblies, such that the rotatable stabilization devices operably bear against a respective surface to support an upstanding portion of the ladder.

21 Claims, 5 Drawing Sheets

LADDER STANDOFF DEVICE

FIELD OF THE INVENTION

The present invention relates to ladder stabilization devices generally, and more particularly to ladder stabilization/standoff devices adapted to provide stabilization characteristics to ladders when placed against both vertical and non-vertical surfaces.

BACKGROUND OF THE INVENTION

A variety of devices have been developed and implemented to stabilize the upper portion of a ladder when placed against a surface in a substantially upright position. Many of these stabilization devices are removably attachable to exterior portions of the respective ladder.

A common example of such a ladder stabilization device presently available is a substantially u-shaped brace that is removably attachable to an exterior portion of a respective ladder via u-bolts or other similar fasteners. Though such brackets are somewhat helpful in stabilizing the ladder from falling, a number of problems are either not addressed or are exacerbated through the use thereof. For example, such braces require separate fasteners to effect an engagement to the ladder, and are therefore cumbersome to quickly attach and detach when repositioning of the brace is desired. In addition, such braces transfer all of the force from the ladder to the supporting surface via padded or unpadded knobs. Since such knobs are of fixed configuration, the brace is subject to unstable footing when not placed against substantially smooth surfaces. Furthermore, the braces transmit a substantial amount of force against the supporting surface through a relatively small surface area, thereby creating the potential of damage to the supporting surface.

A further problem not adequately solved by typical fixed configuration braces is in the situation of placement against a non-vertical surface. The fixed configuration prevents adaptability to such non-vertical surfaces (i.e. rooftops), such that ladder stability is compromised.

Another drawback of currently existing systems is the attachment of the support device to exterior surfaces of the respective ladder via various fastening devices. The fastening devices themselves, in many cases, are called upon to bear much of the force being transferred from the ladder to the stabilizing braces in use. Therefore, such fasteners must be fabricated from very strong and durable materials to safely withstand such forces without significant risk of breakage. Such fasteners are relatively expensive to manufacture, and significantly add to the overall cost of stabilizing a ladder.

A particular drawback of existing systems germane to the present invention is the inadequacy of bracing systems for safely bearing against non-vertical surfaces such that the ladder maintains a standoff configuration from such non-vertical surfaces.

It is therefore a principle object of the present invention to provide a ladder standoff device which enhances ladder stability when placed against both vertical and non-vertical surfaces.

It is another object of the present invention to provide a ladder standoff device that is removably attachable to a ladder without the use of separate fasteners or tools.

It is a further object of the present invention to provide a ladder standoff device that is efficiently removably attachable to a ladder at locations within one or more respective ladder rungs.

It is a yet further object of the present invention to provide a ladder standoff device incorporating pivoting roller devices for efficiently stabilizing the respective ladder when placed against both vertical and non-vertical surfaces.

It is another object of the present invention to provide a ladder standoff device incorporating flexibly conforming stabilization means which, in operation, inhibit separation of respective coupled portions of an extension ladder to which the standoff device is removably attached.

It is a still further object of the present invention to provide independently pivotable roller axis for safely bearing against uneven surfaces.

It is another object of the present invention to provide stabilizing means incorporating a plurality of wheel means having smooth surfaces for preventing damage to structures or surfaces against which the stabilizing means are placed.

It is a still further object of the present invention to provide a ladder standoff device incorporating stabilization means having a plurality of relatively smaller diameter wheel means for bearing against uneven vertical or non-vertical surfaces without compromising ladder stability.

It is a yet further object of the present invention to provide a ladder standoff device which enables an upright ladder to be spaced apart from a vertical or non-vertical surface a useful distance, while simultaneously providing enhanced ladder stability.

It is a further object of the present invention to provide adapter means which enable a ladder standoff device to be universally and removably attached to any ladder in an expeditious manner.

SUMMARY OF THE INVENTION

By means of the present invention, a device providing enhanced ladder stability and maneuverability while minimizing damage to surfaces against which the ladder is placed is obtained. The ladder standoff device of the present invention is quickly removably securable to a ladder, such that separate fastening devices need not be utilized. Stabilization means coupled to the standoff device of the present invention distribute forces generated by leaning a ladder against a respective surface, such that localized pressure on respective surfaces is substantially diminished.

In a particular embodiment of the present invention, a ladder standoff device is provided, including first and second support bracket assemblies operably coupled to a ladder, the first and second support bracket assemblies being operably coupled to one another within one or more substantially hollow ladder rungs, and rotatable stabilization means secured to respective first and second support bracket assemblies, such that the rotatable stabilization means operably bear against a respective surface to support an upstanding portion of the ladder. The first and second support bracket assemblies are preferably coupled within two ladder rungs, which may be adjacent to one another. Each of the support bracket assemblies include first and second support members pivotally connected to one another, wherein the support members are configured to be received in distinct ladder rungs through rung openings in respective sides of the ladder. Preferably, the second support member is pivotally connected to the first support member via a pivot joint disposed intermediate the stabilization means and respective ladder mounting portions of the first and second members. The ladder mounting portions of the first bracket assembly are preferably telescopingly receivable in respective ladder mounting portions of the second support bracket assembly within respective substantially hollow ladder rungs. The ladder mounting portions of the first bracket assembly preferably include engagement shafts protruding therefrom, wherein the engagement shafts have relatively smaller diameters than respective diameters of the first and second ladder mounting portions of the second support bracket assembly, such that the engagement shafts are operably receivable within respective first and second members to thereby operably couple the first and second support bracket assemblies to one another within respective substantially hollow ladder rungs.

The stabilization means preferably include a plurality of wheels which include a resilient, anti-slip exterior surface to minimize damage of the respective surface against which the stabilization means operably bears. The stabilization means also preferably includes a mounting transaxle operably coupled to a respective support bracket assembly in a plane substantially transverse to a respective distal end of the support bracket assembly, and one or more swing arms pivotally connected to respective distal ends of the mounting transaxle, the wheels being rotatably secured to respective swing arms. Preferably, the stabilization means are weighted such that the swing arms maintain a substantially vertical attitude when freestanding.

The ladder standoff device of the present invention preferably also includes tension means operably disposed between the first and second support bracket assemblies to thereby assist in securing the first and second support bracket assemblies together. The tension means preferably extends between respective pivot joints of the first and second support bracket assemblies.

In another embodiment of the present invention, a ladder standoff device is provided, including first and second support bracket assemblies having respective proximal and distal ends, wherein respective proximal ends are universally and removably coupled to a plurality of adapter brackets being operably connected to a ladder, and stabilization means secured to respective distal ends of the first and second support bracket assemblies, wherein the stabilization means include a first transaxle connected to respective distal ends of the first and second support bracket assemblies in substantially transverse relationship therewith, at least one swing arm transversely connected to the first transaxle, and a plurality of wheel means rotatably secured to the swing arm.

DETAILED DESCRIPTION OF THE PREFERRED EMBODIMENTS

The objects and advantages enumerated above together with other objects, features, and advances represented by the present invention will now be presented in terms of detailed embodiments described with reference to the attached drawing figures which are intended to be representative of various possible configurations of the invention. Other embodiments and aspects of the invention are recognized as being within the grasp of those having ordinary skill in the art.

Figure 1:
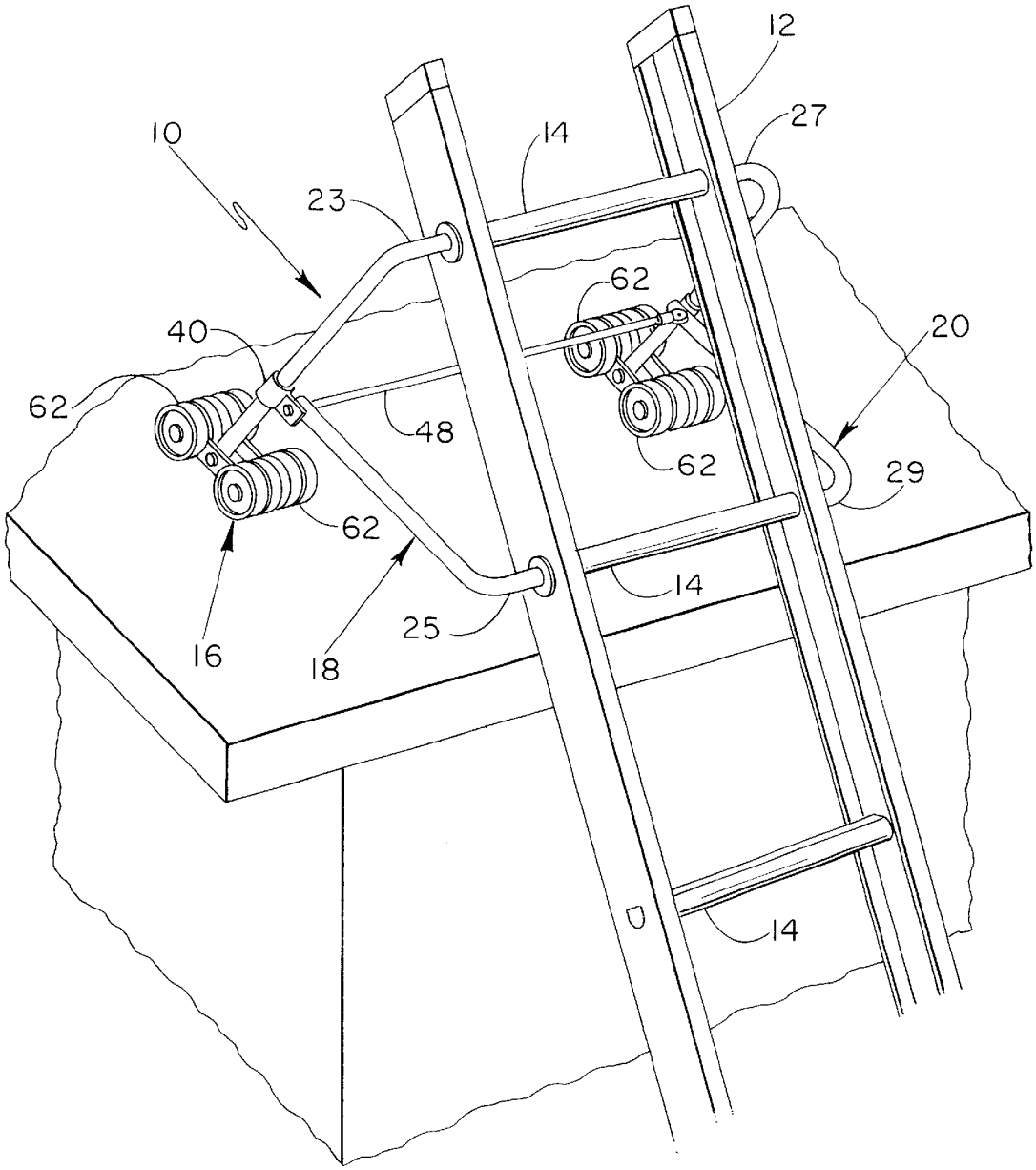
FIG. 1 is a perspective view of the ladder standoff device of the present invention as operably coupled to an upstanding portion of a ladder.

Referring now by characters of reference to the drawings, and first to FIG. 1, a ladder standoff device 10 is shown as assembled and removably attached to a ladder 12. In the embodiment illustrated in FIG. 1, ladder standoff device 10 is shown being removably attached to ladder 12 within respective ladder rungs 14. Ladder standoff device 10 preferably includes stabilization means 16 secured to first and second bracket assemblies 18, 20.

Figure 3:
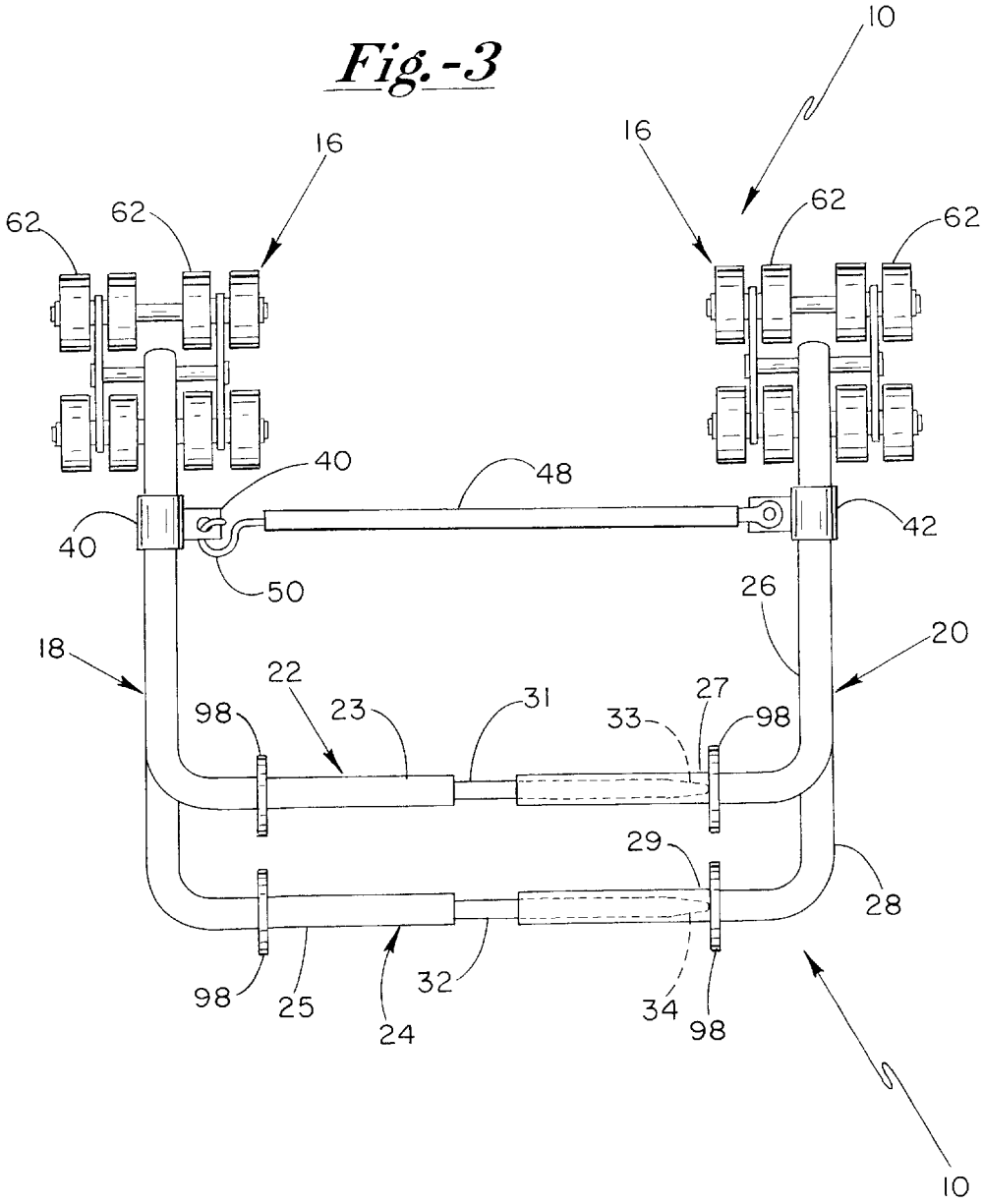
FIG. 3 is a top elevational view of the ladder standoff device as illustrated in FIG. 1.

Ladder standoff device 10 may also be seen in the isolation view of FIG. 3. First and second support bracket assemblies 18, 20 are illustrated being operably coupled to one another. In preferred embodiments of the present invention, a portion of first support bracket assembly 18 is telescopingly received in a corresponding portion of second support bracket assembly 20 within respective ladder rungs 14. Preferably, each support bracket assembly 18, 20 includes first and second support members 22, 24, and 26, 28, respectively, which support members are preferably hollow. Support members 22, 24, 26, 28 each preferably include ladder mounting portions 23, 25, 27, 29, respectively. As shown in FIG. 3, ladder mounting portions 23, 25 of respective support members 22, 24 are preferably operably and telescopingly received at least partially within ladder mounting portions 27, 29 of respective support members 26, 28. In a particular embodiment of the present invention, engagement shafts 31, 32 extending outwardly from respective ladder mounting portions 23, 25 are telescopingly received in ladder mounting portions 27, 29 of second support bracket assembly 20. Engagement shafts 31, 32 preferably have relatively smaller diameters than respective diameters of ladder mounting portions 27, 29, such that the respective engagement shafts may be telescopingly received therein. In such a manner, first and second support bracket assemblies 18, 20 operably engage with one another in an efficient manner without the use of tools or other fastening devices.

As shown in FIG. 3, ladder mounting portions 23, 25, 27, 29 preferably include respective limit stops disposed circumferentially thereabout. In embodiments wherein respective ladder mounting portions 23, 25, 27, 29 are operably coupled to one another within respective ladder rungs, respective limit stops 98 operably engage with the respective ladder stiles to maintain an appropriate distance between first and second support bracket assemblies 18, 20 and the ladder. In such a manner, first and second support bracket assemblies 18, 20 are spaced from the ladder, and therefore are not interfered with by the ladder. Limit stops 98 are preferably positioned so as to provide a desired degree of engagement between respective ladder mounting portions 23, 25, 27, 29.

A variety of other engagement means between first and second support bracket assemblies 18, 20 are envisioned in the present invention, though telescopic engagement therebetween is preferred. An example of an alternative engaging means between first and second support bracket assemblies 18, 20 include a mounting sleeve (not shown) for simultaneously engaging respective ends of ladder mounting portions 23, 25 and 27, 29. Preferred embodiments of the present invention provide for engagement between first and second support bracket assemblies 18, 20 within substantially hollow ladder rungs 14. Though ladder standoff device 10 is preferably self-supporting and does not rely upon rungs 14 for support, engagement within ladder rungs 14 provides for efficient and strong engagement without the use of separate fastening devices, as well as an enhanced degree of lateral support of ladder standoff device 10. In some cases, the integrated structure of rungs 14 with ladder 12 provide additional lateral strength to ladder mounting portions 23, 25, 27, 29 operably engaged therewithin. Thus, additional support to inhibit lateral movement of respective portions of support mounting brackets 18, 20 within respective ladder rungs 14 is provided by the body walls of rungs 14, such that separate fastening devices at respective engagement points are not required in the device of the present invention.

Though the present invention is illustrated incorporating two support members for each support bracket assemblies 18, 20, the present invention contemplates the use of various numbers of support members to adapt to various applications. However, utilization of two support members per support bracket assembly is most preferred to obtain a substantially triangular support regime.

Figure 2:
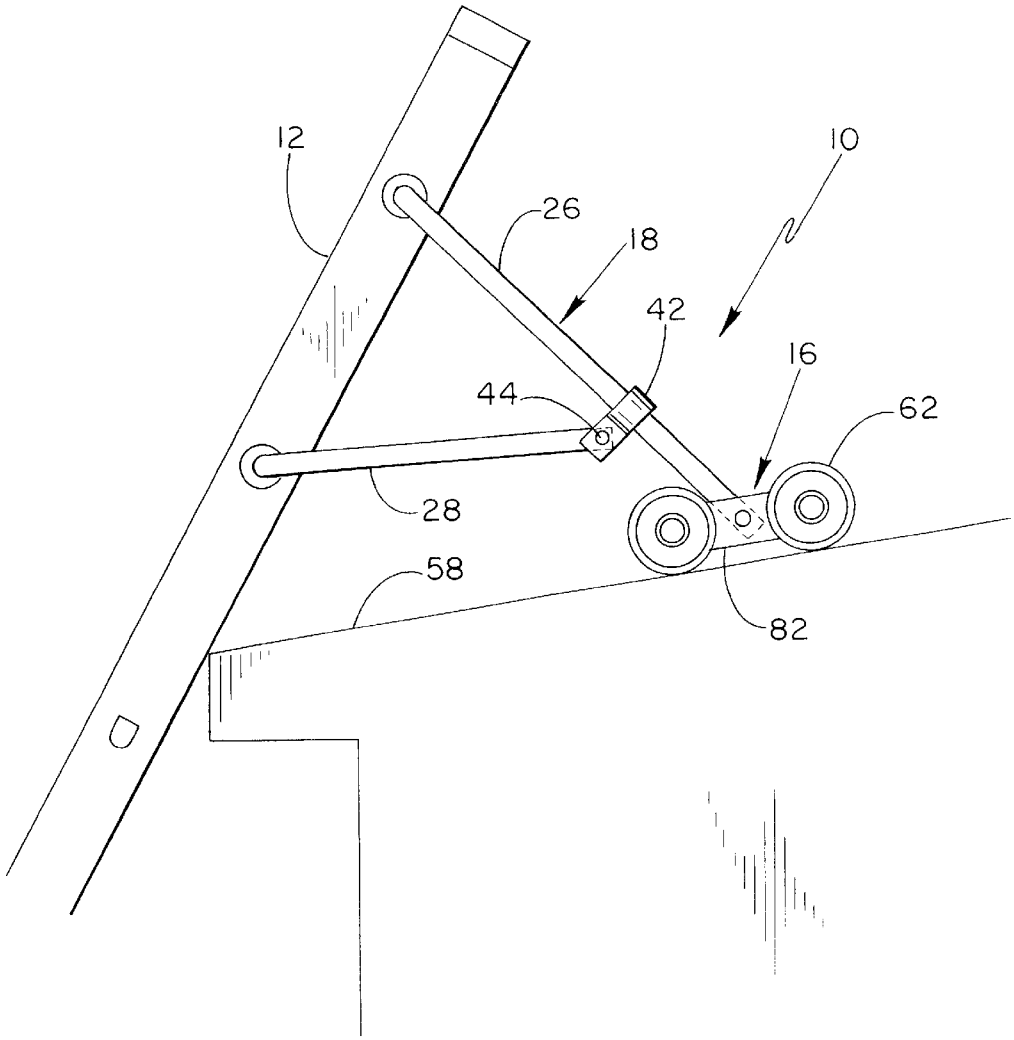
FIG. 2 is a side view of the ladder standoff device as illustrated in FIG. 1.

As shown in FIG. 2, support members 24, 28 are preferably pivotally secured to respective support members 22, 26 at respective pivot joints 40, 42. In preferred embodiments, pivot joints 42 are fixedly secured to first support members 26, and are pivotally connected to second support member 28, such that second support member 28 pivots with respect to first support member 26. Pivot joint 42 preferably includes a pivot pin extending through both second support member 28 and pivot joint 42, such that the pivotally secured end of second support member 28 is rotatably mounted about pivot pin 24. In alternative embodiments, first support members 26 may be pivotally secured to second support member 28 such that pivot joint 42 is fixedly attached to second support member 28, and first support member 26 is pivotally secured to pivot joint 42 via pivot pin 44. A similar configuration is provided for first support bracket assembly 18 as was described above for second support bracket assembly 20.

In some embodiments of the present invention, a locking means is provided for pivot joint 42 such that a desired configuration of respective support bracket assemblies 18, 20 may be held securely in place. The pivoting relationship between respective first and second members of first and second support bracket assemblies 18, 20 is provided such that respective support bracket assemblies 18, 20 are able to adapt to various ladder rung spacing among distinct ladders.

To assist in holding first and second support bracket assemblies 18, 20 to one another, tension means 48 is positioned between, and operably coupled to respective support bracket assemblies 18, 20. As shown in FIG. 3, tension means 48 is preferably removably securable to respective pivot joints 40, 42 of support bracket assemblies 18, 20. Tension means 48 is preferably an elastic and resilient band having removable attachment means 50 secured thereto. In operation, tension means 48 is stretched such that removable securement means 50 may be inserted through a corresponding aperture in pivot joint 40 so as to removably connect first bracket assembly 18 to second bracket assembly 20. Tension means 48 may be in a variety of forms, so long as first and second support bracket assemblies 18, 20 are operably held in engaging relationship with one another.

Stabilization means 16 are preferably secured to each of first and second support bracket assemblies 18, 20. In preferred embodiments of the invention, stabilization means 16 are pivotally secured at respective distal ends of first and second support bracket assemblies 18, 20. In the embodiment illustrated in FIG. 2, stabilization means 16 are pivotally secured to respective distal ends of support members 22, 26, such that placement of stabilization means 16 against surface 58 supports and stabilizes ladder 12 via first and second support bracket assemblies 18, 20.

Figure 4:
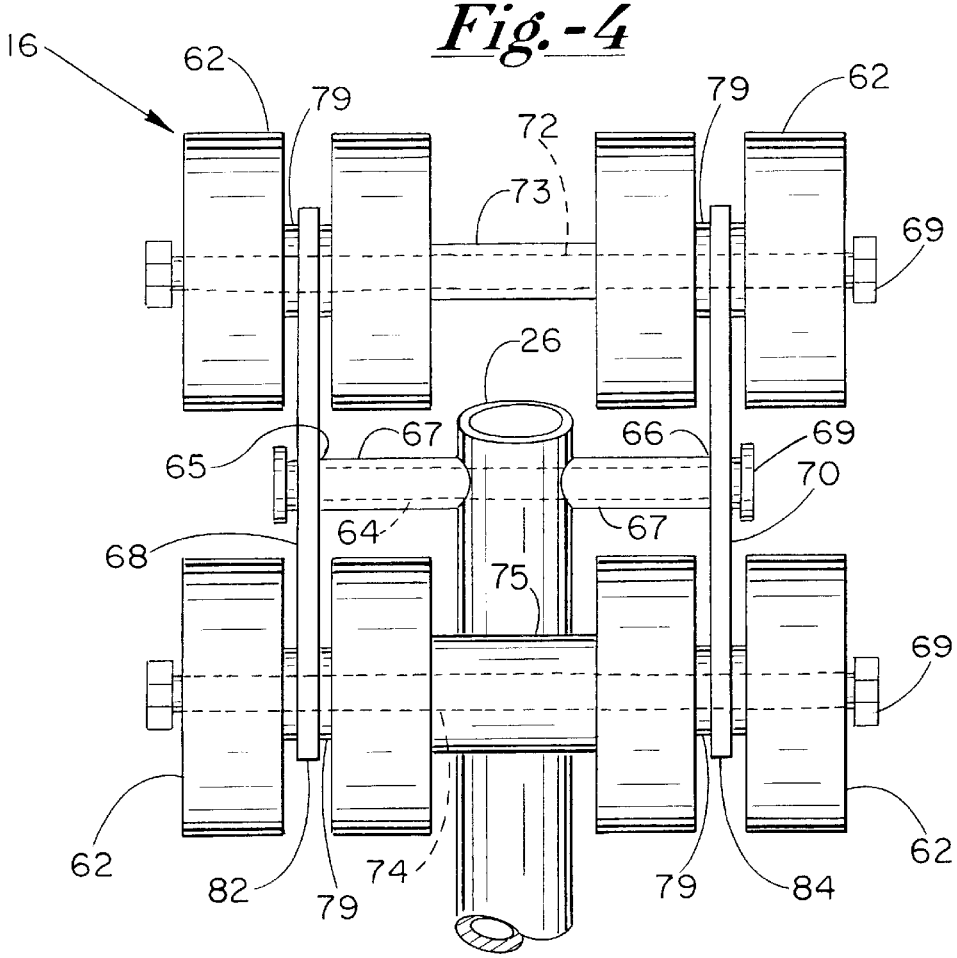
FIG. 4 is a bottom view of a stabilization means of the standoff device as illustrated in FIG. 1.
Figure 5:
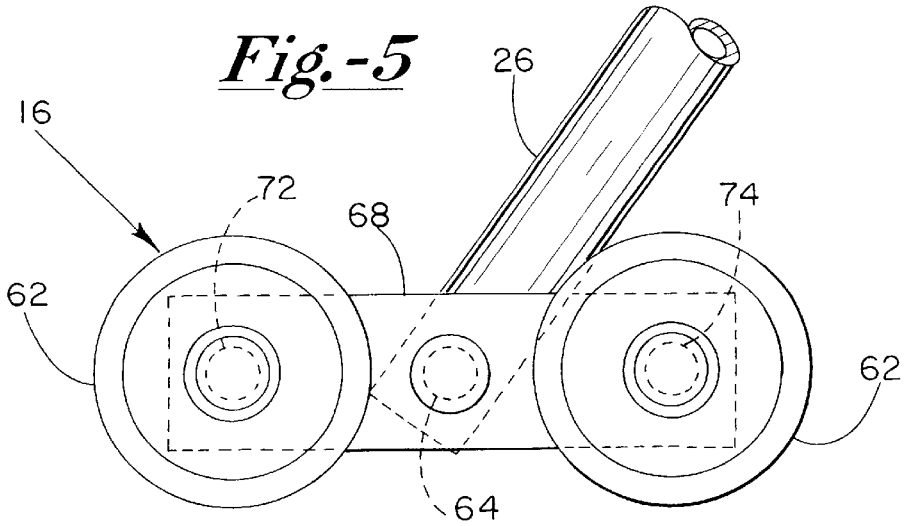
FIG. 5 is a side view of the stabilization means illustrated in FIG. 4.

As can be seen more easily in FIGS. 4 and 5, stabilization means 16 preferably include a plurality of wheel means 62 rotatably mounted thereto. A variety of mechanisms by which wheel means 62 are rotatably secured to stabilization means 16 are contemplated by the present invention. A preferred embodiment is illustrated in FIG. 4, wherein a first central transaxle 64 extends transversely through a respective end of first or second support bracket assemblies 18, 20, and in particular, respective distal ends of support members 22, 26. In preferred embodiments, first transaxle 64 extends through an aperture of a respective support member 22, 26, along an axis substantially transverse to support members 22, 26. Preferably, transaxle 64 is simply a shaft of relatively smaller diameter than the respective aperture in support members 22, 26.

Respective opposed ends 65, 66 of first transaxle 64 preferably extend through respective first and second swing arms 68, 70, which swing arms are substantially perpendicular to first transaxle 64. Retaining end caps 69 are provided at respective ends 65, 66 of first transaxle 64 to thereby prevent respective swing arms 68, 70 from disengaging from first transaxle 64. In preferred embodiments, first transaxle spacers 67 are axially disposed circumferentially about first transaxle 64 at positions between respective distal ends of support members 22, 26 and respective first and second swing arms 68, 70 to thereby maintain a minimum spacing between respective swing arms and the respective distal end of support members 22, 26. Spacers 67 are preferably hollow, and have an inside diameter somewhat greater than the diameter of first transaxle 64. Retaining end caps 69 are preferably disposed at respective opposed ends 65, 66 of first transaxle 64 so as to limit lateral motion of respective swing arms 68, 70 along first transaxle 64, and further to prevent respective swing arms 68, 70 from disengaging from first transaxle 64. Preferably, space is provided between end cap 69 and respective 68, 70 to allow a degree of independent pivoting of respective swing arms 68, 70. Spacers 67 and end caps 69 are preferably provided such that respective support members 22, 26 maintain a substantially centered disposition between respective swing arms 68, 70.

First transaxle 64 preferably extends through respective swing arms 68, 70 at or near respective midpoints thereof. Wheel means 62 are preferably rotatably mounted to respective swing arms 68, 70 and are preferably mounted at respective distal ends thereof. In some embodiments of the present invention, only a single swing arm incorporating a plurality of wheel means 62 is utilized. In other embodiments, however, more than two swing arms are utilized in each distinct stabilization means 16. A particular object of the present invention is obtained by incorporating a plurality of wheel means 62, such that the force transferred to surface 58 by each individual wheel means 62 is minimized and divided among all of the plurality of wheel means 62. Surface 58 is illustrated as being a vertical surface, but any pitched surface may be adapted to by the present invention. In particular, surfaces such as rooftops and upstanding walls are particularly contemplated as being adapted to by the present invention.

In some embodiments of the present invention, respective distal ends of swing arms 68, 70 are interconnected via second and third transaxles 72, 74, which act, in combination, to somewhat unify rotational movement of stabilization means 16. As shown in FIG. 4, wheel means 62 are rotatably mounted about second and third transaxles 72, 74. In a preferred embodiment, second transaxle spacer 73 is circumferentially disposed about second transaxle 72 at a position between first and second swing arms 68, 70. Second transaxle spacer 73 is preferably positioned between wheel means 62 on second transaxle 72 to thereby maintain spacing therebetween, and to substantially maintain respective wheel means 62 at positions adjacent to respective swing arms 68, 70. As illustrated in FIG. 4, wheel means 62 are preferably provided at positions between second transaxle spacer 73 and respective swing arms 68, 70 as well as between respective swing arms 68, 70 and respective end caps 69. Excess space is preferably provided for the components between respective end caps 69 on respective transaxles 64, 72, 74, such that a degree of flex and independent rotation is provided to stabilization means 16.

Wheel means 62, third transaxle spacer 75, and respective end caps 69 are preferably arranged about third transaxle 74 in a similar fashion to those elements described with respect to second transaxle 72. To enhance rotation of wheel means 62, bosses 79 are provided on wheel means 62. Such bosses 70 maintain a minimum spacing between wheel means 62 and respective swing arms 68, 70.

An alternative embodiment of the present invention provides for a first transaxle 64 being rotatably coupled to a respective end of first or second support bracket assemblies 18, 20 at respective distal ends of support members 22, 26. In such an embodiment, transaxle 64 is preferably rotatable within the respective support members 22, 26, such that a pivoting characteristic may be obtained for stabilization means 16. In some embodiments, transaxle 64 is mounted within a rotatable ball-bearing assembly in a respective support member 22, 26.

First transaxle 64 may be fixedly secured to respective swing arms 68, 70, whereby rotation of first transaxle 64 correspondingly rotates first and second swing arms 68, 70. In other embodiments, however, first transaxle 64 is rotatably secured to swing arms 68, 70 such that swing arms 68, 70 may rotate independently of first transaxle 64. In such an embodiment, first transaxle 64 provides orientational alignment, but does not directly control rotation of respective swing arms 68, 70.

In some embodiments of the present invention, respective distal ends of swing arms 68, 70 are fixedly connected to second and third transaxles 72, 74, thereby unifying rotational movement of stabilization means 16. In such a manner, wheel means 62 rotate about respective second and third transaxles 72, 74 in unison, and form a singular rotatable surface made up of a plurality of individual wheel means 62. In such a manner, force from ladder 12 to surface 58 is simultaneously transferred through all wheel means 62 of stabilization means 16. In other embodiments, however, swing arms 68, 70 are not interconnected via second and third transaxles 72, 74, whereby respective swing arms 68, 70 may rotate independently of one another. Such independent rotation provides for smooth engagement with rough or uneven surfaces 58.

In preferred embodiments of the present invention, wheel means 62 include a resilient, anti-slip exterior surface to minimize damage of surface 58 when stabilization means 16 are pressed thereagainst. Such a resilient, anti-slip surface may be comprised of, for example, a rubberized, or polycoated surface.

An additional important aspect of the present invention includes the provision of weight means in stabilization means 16. Preferably, such weight means are incorporated in third transaxle spacer 75, or, in an alternative embodiment, at corresponding end portions 82, 84 of respective swing arms 68, 70. Such weight means operate to maintain a substantially vertical attitude, as shown in FIG. 5, when stabilization means 16 is freestanding, and not pressed against surface 58. Such a vertical attitude assists in transporting and orienting ladder 12 in desired positions without inhibition by stabilization means 16. In effect, such a vertical attitude maintains a relatively innocuous profile of ladder 12, whereby stabilization means 16 will not tend to catch or hook on surrounding objects. When ladder 12, and correspondingly stabilization means 16, is placed against a surface 58, stabilization means 16 automatically conforms to the slope of surface 58 via the applied force of ladder 12 on stabilization means 16.

Figure 6:
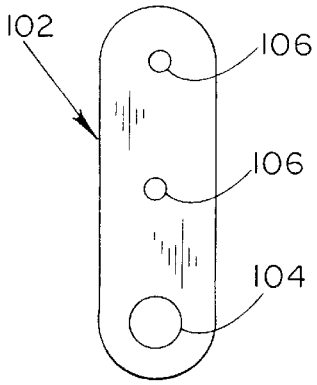
FIG. 6 is a side view of an adapter bracket in accordance with the present invention.

In another embodiment of the present invention, standoff device 10 may be utilized with ladders not having hollow rungs through the use of adapter brackets 102. As shown in FIG. 6, adapter brackets 102 preferably include an elongated plate having a plurality of apertures disposed therein. In preferred embodiments, adapter bracket 102 preferably includes a support member receiving aperture 104 and one or more mounting apertures 106. Preferably, adapter bracket 102 is substantially planar, and is fabricated from a relatively strong and durable material, such as aluminum, steel, or the like. In some embodiments of the present invention, adapter bracket 102 includes a boss 108 extending outwardly therefrom about support member receiving aperture 104. Boss 108 is utilized in particular embodiments where spacing from a ladder surface to which adapter bracket 102 is mounted is desired.

Figure 7:
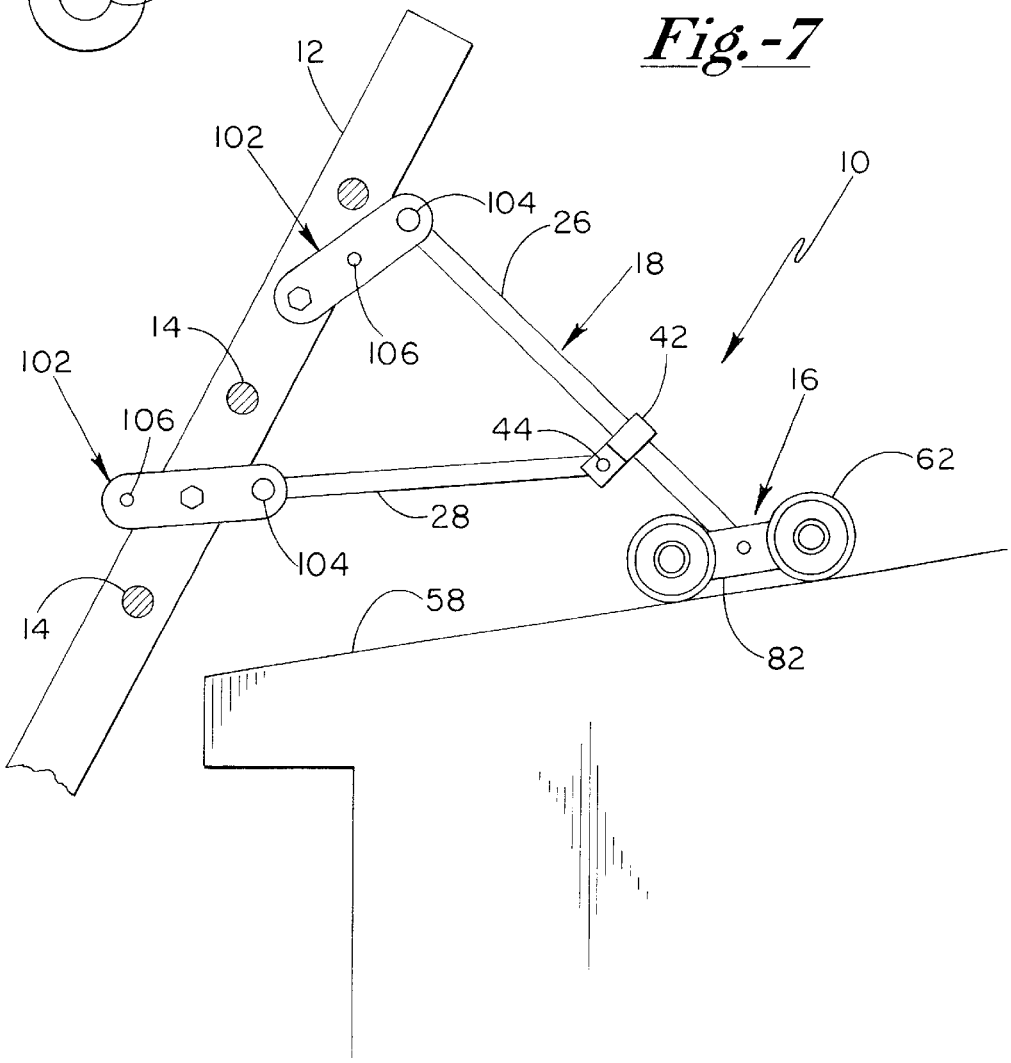
FIG. 7 is a side view of a ladder standoff device mounted to a ladder via adapter brackets of the present invention.

Adapter bracket 102 is shown in use in FIG. 7, and is illustrated as being connected to ladder 12 via fasteners mounted through mounting apertures 106 and adapter bracket 102. In preferred embodiments, adapter bracket 102 is mounted to ladder 12 by inserting a fastener such as a bolt or the like through a respective mounting aperture 106 and through a corresponding aperture drilled in a respective stile of ladder 12. Adapter bracket 102 is preferably configured to be mounted to an inside surface of a respective ladder stile, though attachment of adapter bracket 102 to an outer surface of respective ladder stiles is also contemplated in the present invention.

In preferred embodiments, adapter bracket 102 is permanently secured to ladder 12, such that expeditious engagement of standoff device 10 thereto may be accomplished. Where adapter bracket 102 is utilized in conjunction an extension ladder, it is preferred that respective adapter brackets be permanently mounted to an inside surface of the respective ladder stiles, thereby not inhibiting retraction of the extension portion of extension ladder 12.

As shown in FIG. 7, adapter brackets 102 provide mounting receptacles for respective first and second support bracket assemblies 18, 20, in that an adapter bracket 102 is provided for each support member 26, 28. Because standoff device 10 is self-supporting as assembled, the present invention need only apertures through which respective support members 26, 28 of respective first and second support bracket assemblies 18, 20 may be mounted. In such a manner, standoff device 10 may be utilized with ladder 12 not having externally accessible hollow rungs.

As a particular feature of the present invention, respective mounting apertures 106 are positioned above the line of tension as developed in operation, so that correct clearances may be maintained between respective support members 26, 28 and ladder 12, as well as to surface 58. Preferably, the fasteners are not completely tightened, such that adapter brackets 102 may pivot about the fastener in mounting aperture 106.

As can be seen from the figures, ladder standoff device 10 may be universally utilized with any ladder 12. Standoff device 10 utilizes either adjacent ladder rungs 14 or adapter brackets 102, into which respective ladder mounting portions 23, 25, 27, 29 are inserted. Second support members 24, 28 preferably provide a bracing or support characteristic to respective upper support members 22, 26. In preferred embodiments of the present invention, wheel means 62 are about two inches in diameter and are clustered in groups of at least eight per individual stabilization means 16. As may be particularly seen in FIG. 3, engagement shafts 31, 32 preferably include tapered ends 33, 34 to provide ease of insertion of respective engagement shafts into respective ladder mounting portions 27, 29 of second support bracket assembly 20.

In operation, ladder standoff device 10 provides both stability and maneuverability for ladder 12 when placed against surfaces of various pitch and evenness. Respective first and second support bracket assemblies 18, 20 extend outwardly of ladder 12 to provide additional stabilization therefor. In addition, standoff device 10 provides for a ladder orientation wherein an upper portion of ladder 12 is spaced from surface 58 a distance convenient for ladder users in activities such as painting, roof gutter servicing and installation, and access to overhanging roofs. The plurality of wheel means 62 on stabilization means 16 disperses the force of ladder 12 against surface 58 among each of the plurality of wheel means 62, thereby minimizing localized force on surface 58. In such a manner, damage to surface 58 is substantially minimized or eliminated altogether. The anti-slip material on wheel means 62 prevents lateral slippage of stabilization means 16, and correspondingly ladder 12 when placed against surface 58.

An additional aspect of the present invention includes a safety strap which is removably attachable to one or more, preferably two, ladder stiles and a rain gutter or other projection to thereby further stabilize ladder 12, and to further prevent ladder 12 from falling from a substantially vertical orientation against surface 58.

A number of advantages are introduced by the present invention. For example, ladder standoff device 10 may be removably and universally engaged with any ladder 12 without the use of tools, and in a timely manner. In addition, individual support bracket assemblies. 18, 20 of standoff device 10 are removably engageable to one another within substantially hollow ladder rungs 14 or adapter brackets 102, such that a heightened level of strength of the engaged brackets is obtained without the use of separate fastening elements. Where standoff device 10 is utilized in conjunction with a slidably engaging extension ladder, standoff device 10 need not be removed before adjusting the height of ladder 12, because the interior engagement of respective support bracket assemblies 18, 20 does not interfere with the sliding engagement of corresponding pieces of extension ladder 12. Pivoting stabilization means 16 provides safe and secure engagement with surface 58 even where surface 58 is uneven. In particular, swing arms 68, 70 efficiently conform to uneven surfaces of surface 58. In addition, the plurality of wheel means 62 distribute the force of ladder 12 against surface 58 such that damage to surface 58 is substantially reduced or eliminated altogether. To further minimize damage to surface 58, a rubberized or other resilient anti-slip surface of wheel means 62 is provided.

The invention has been described herein in considerable detail in order to comply with the patent statutes, and to provide those skilled in the art with the information needed to apply the novel principles and to construct and use embodiments of the invention as required. However, it is to be understood that the invention can be carried out by specifically different devices and that various modifications can be accomplished without departing from the scope of the invention itself.

What is claimed is:

1. In operable combination with a ladder, a ladder standoff device comprises:

(a) first and second support bracket assemblies operably coupled to the ladder, said first support bracket assembly including a first ladder mounting portion integrally formed therewith, and said second support bracket assembly including a second ladder mounting portion integrally formed therewith, said first ladder mounting portion being specifically configured to be directly and matingly received within said second ladder mounting portion so as to operably engage said first and second support bracket assemblies to one another, said first and second support bracket assemblies being operably engaged with one another through one or more connection apertures formed in respective coupling bodies that are structurally connected to the ladder; and (b) stabilizing means pivotally secured to respective said first and second support bracket assemblies, such that said stabilizing means operably bear against a respective surface to support an upstanding portion of the ladder, said stabilizing means including first and second chassis members independently pivotally secured to respective said first and second support bracket assemblies such that each of said first and second chassis members freely pivot independently with respect to one another, said first and second chassis members each include one or more transaxles secured thereto and one or more swing arms connected to and interconnecting respective distal ends of said one or more transaxles on respective said chassis members.

2. The ladder standoff device as in claim 1 wherein said coupling bodies are ladder rungs.

3. The ladder standoff device as in claim 1 wherein each said support bracket assembly comprises first and second support members.

4. The ladder standoff device as in claim 3 wherein respective said support members each include one of said distinct ladder mounting portions associated and integrally formed therewith.

5. The ladder standoff device as in claim 3 wherein respective said second support members are pivotally connected to respective said first support members.

6. The ladder standoff device as in claim 4 wherein said ladder mounting portions of said first support bracket assembly are telescopingly receivable in respective ladder mounting portions of said second support bracket assembly.

7. The ladder standoff device as in claim 1 wherein respective said transaxles include a plurality of wheels operably coupled thereto.

8. The ladder standoff device as in claim 7 wherein said wheels include a resilient, anti-slip exterior surface to minimize damage of the respective surface against which said wheels operably bear.

9. The ladder standoff device as in claim 1 wherein selected said transaxles are weighted such that respective said chassis members maintain a substantially vertical attitude when free-standing.

10. The ladder standoff device as in claim 1, including tension means operably disposed between said first and second support bracket assemblies to thereby assist in securing said first and second support bracket assemblies together.

11. The ladder standoff device as in claim 1 wherein said coupling bodies are distinct adapter brackets which are adapted to operably connect to respective stiles of the ladder.

12. A ladder standoff device for use with, and operably coupled to, a ladder, said ladder standoff device, comprising:

(a) first and second support bracket assemblies having respective proximal and distal ends, respective proximal ends being specifically configured so as to be directly matingly engageable with one another through apertures in respective adapter brackets which are adapted to be operably connected to the ladder; and (b) stabilizing means pivotally secured to respective said distal ends of said first and second support bracket assemblies, said stabilizing means include first and second chassis members independently pivotally secured to respective distal ends of said first and second support bracket assemblies such that each of said first and second chassis members freely pivot independently with respect to one another, each of said first and second chassis members include a first transaxle and at least one swing arm transversely connected to respective said first transaxle at a location on said respective first transaxle spaced from said respective first or second support bracket assembly, and a plurality of wheels operably connected to said respective swing arm.

13. The ladder standoff device as in claim 12 wherein said first transaxles extend through respective distal ends of said first and second support bracket assemblies.

14. The ladder standoff device as in claim 12 wherein said swing arm is pivotally connected to said first transaxle.

15. The ladder standoff device as in claim 12, including a plurality of swing arms pivotally connected to said first transaxle, wherein said first transaxle defines an axis of rotation for said swing arms.

16. The ladder standoff device as in claim 15 wherein two said swing arms are pivotally connected to opposed ends of said first transaxle.

17. The ladder standoff device as in claim 15 wherein respective opposed ends of said swing arms are interconnected via second and third transaxles, respectively.

18. The ladder standoff device as in claim 15 wherein respective swing arms independently pivot about the axis of rotation defined by said first transaxles.

19. The ladder standoff device as in claim 18 wherein selected said wheels are rotatably connected to respective said swing arms.

20. The ladder standoff device as in claim 12 wherein said adapter brackets are adapted to operably mount to inner surfaces of respective ladder stiles.

21. The ladder standoff device as in claim 12 wherein each said support bracket assembly comprises first and second support members pivotally connected to one another.

* * * * *